US006130394A

United States Patent [19]

Högl

[11] Patent Number: 6,130,394

[45] Date of Patent: Oct. 10, 2000

[54] HERMETICALLY SEALED VACUUM LOAD INTERRUPTER SWITCH WITH FLASHOVER FEATURES

[75] Inventor: Vitus Högl, Moosburg, Germany

[73] Assignee: Elektrotechnische Weke Fritz Driescher & Söhne GmbH, Moosburg, Germany

[21] Appl. No.: 09/256,997

[22] Filed: Feb. 25, 1999

Related U.S. Application Data

[63] Continuation of application No. PCT/EP97/04617, Aug. 25, 1997.

[30] Foreign Application Priority Data

Aug. 26, 1996 [DE] Germany ..... 196 34 451

[51] Int. Cl.[7] ..... H01H 33/66; H01H 9/04

[52] U.S. Cl. ..... 218/138; 218/139

[58] Field of Search ..... 200/302.1, 302.2, 200/302.3; 218/134, 135, 136, 137, 138, 139, 43

[56] References Cited

U.S. PATENT DOCUMENTS

| | | | |
|---|---|---|---|
| 3,594,525 | 7/1971 | Miller et al. | 218/140 |
| 3,671,696 | 6/1972 | Brunner | 218/126 |
| 3,955,167 | 5/1976 | Kumbera | 218/118 X |
| 4,088,859 | 5/1978 | Hruda | 200/83 D |
| 4,124,790 | 11/1978 | Kumbera et al. | 218/138 |
| 4,393,286 | 7/1983 | Takagi | 174/209 |
| 4,484,044 | 11/1984 | Yoshigae | 218/6 |
| 4,568,804 | 2/1986 | Luehring | 218/138 |
| 4,618,749 | 10/1986 | Bohme et al. | 218/134 |
| 5,597,992 | 1/1997 | Walker | 218/124 X |

FOREIGN PATENT DOCUMENTS

| | | |
|---|---|---|
| 070 794 | 1/1983 | European Pat. Off. . |
| 2 698 481 | 5/1994 | France . |
| 20 18 968 | 11/1970 | Germany . |
| 93 14 754 | 3/1994 | Germany . |
| 1191664 | 5/1970 | United Kingdom . |
| 2 029 643 | 3/1980 | United Kingdom . |
| WO9809310 | 3/1998 | WIPO . |

*Primary Examiner*—J. R. Scott

*Attorney, Agent, or Firm*—Pillsbury Madison & Suto LLP

[57] ABSTRACT

A load interrupter switch for voltages in the kV range and having a vacuum interrupter chamber which is embraced without any air gaps by a sleeve formed from elastomeric material of high dielectric strength. The sleeve is clamped by half housings of the load interrupter switch. In this way, an external flashover of the high voltage between the end plates of the vacuum interrupter chamber is effectively suppressed during the switching operation without the need for liquid or gaseous media for this purpose. As a result, unlike conventional load interrupter switches there is no need for an extensive level of monitoring. Furthermore, the load interrupter switch does not pose the risk of leaking unobjectionable fluids or gases which may cause environmental hazards.

10 Claims, 2 Drawing Sheets

HERMETICALLY SEALED VACUUM LOAD INTERRUPTER SWITCH WITH FLASHOVER FEATURES

This is a continuation of: 14(b) International Appln. No. PCT/EP97/04617 filed Aug. 25, 1997 which designated the U.S.

BACKGROUND OF THE INVENTION

1. Field of the Invention

This invention relates to a load interrupter switch for voltages above 1 kV. More specifically, this invention relates to load interrupter switch having a vacuum interrupter chamber whose contacts are closed or opened using a switching mechanism, wherein the vacuum interrupter chamber has a housing with metallic end plates which encloses the switching contacts situated in the vacuum, and a cylindrical housing middle part made from an electrically insulating material, of which the housing is surrounded by a dielectric medium.

2. Description of Related Art

Load interrupter switches are commonly used as switch-disconnectors in railway operations. In such a case, in the closed position, the vacuum interrupter chamber together with the switching mechanism accommodated in an insulating housing, is electrically connected in parallel with the traction circuit designed for the full nominal equipment current. During disconnection, the main contacts are opened when de-energized and in the process transmits the current into the vacuum interrupter chamber and auxiliary switching point, which has an actuating fork. As soon as the main contacts have moved apart far enough from one another, the vacuum interrupter chamber is quickly actuated via a tilting mechanism. The breaking arc occurring in the interior of the interrupter chamber is extinguished at the first current zero without appearing externally.

However, such vacuum interrupters or interrupter chambers are relatively large and have high production costs. Consequently, because of the size and cost of vacuum interrupter chambers, vacuum interrupter chambers using a lower voltage series than that for which the switches have been designed are commonly used. However, it is possible to reduce both the dimensions and the production costs of conventional vacuum interrupter chambers.

However, the reduction in overall size, also attended by reduces the spacing of the metallic end plates of the housing of the vacuum interrupter chamber. In this case the external insulation, which is stressed during and after the disconnection, is insufficient in size to prevent air from flowing from or into the surrounding environment.

In order to solve this problem, the vacuum interrupter chambers are arranged in a medium of higher dielectric strength. It is possible in this case to apply insulating oil, such as mineral oil or silicone oil, various esters or an insulating gas such as, sulphurhexafluoride ($SF_6$). These mediums displace the air in the surroundings of the vacuum interrupter chambers and, since they have a high dielectric strength, an external flashover is prevented.

However, the use of such mediums may cause objectionable environmental hazards. Since such load interrupter switches are used for many years, the probability of leaks due to aging of the components of the load interrupter switches is greatly increased along with the probability that such of the mediums may escape into the environment.

A further disadvantage of such mediums is that they require continuous monitoring. When using insulating oil, periodically checking the oil level is necessary. Since such load interrupter switches are installed on high masts in most cases, a corresponding outlay is required. The situation is similar when using insulating gas, wherein the pressure must be checked periodically.

Encapsulation using epoxy resin, may also be used to improve the external insulation of the vacuum interrupter chambers by. However, as the vacuum interrupter chamber ages, an air gap may occur which may lead to an external flashover in the region between the epoxy resin casing and the outer housing. Such aging may cause stress cracks due to after-shrinkage of the cast resin jacket, and embrittlement due to loss of effectiveness by flexibilizers which were used during encapsulation. As a consequence of differential material expansion during frequent alternating stress between hot and cold, the formation of gaps by detachment of the resin jacket from the outer housing of the vacuum interrupter chamber may occur. This risk cannot be entirely removed or ignored. The fact that such an encapsulated vacuum interrupter chamber can be accessed when dismounting only by destroying the enclosure is a further disadvantage.

The embodiments disclosed above are complicated and may be used only on a conditionally basis, and are frequently rejected because of possibility of endangering the environment.

The French patent FR-2 698 481 A1 discloses a load interrupter switch having a vacuum interrupter chamber, an electrically insulating body made from silicone being arranged between the housing of the vacuum interrupter chamber and an outer housing. The silicone body is tubular and has elastically deformable ribs either on the outside or on the inside. It is made so that the simultaneously makes intimate contact with the outer surface of the interrupter chamber housing and the inner surface of the outer housing. The aim here is to achieve an absence of a gap in order to avoid an electric flashover. In addition, it is possible during mounting to introduce an insulating grease in the region between the interrupter chamber housing and the inside of the silicone body, while the ribs on the outside are compressed at least slightly in order to produce a seal.

German Utility Model G 93 14 754 U1 has disclosed a vacuum interrupter having an encapsulation resistant to internal pressure. The encapsulation of this vacuum interrupter comprises an inner coating made from a hard foam plastic, and an outer burst-proof jacket. The inner coating, preferably consisting of a polyurethane foam, which is uniformly porous to permit the best possible thermal insulation. The inner coating will prevent the temperature from rising to a sufficient level to ignite the surrounding gas. The burst-proofjacket is constructed as a wound body, and comprises threads or strips which are impregnated with a cured plastic. It is constructed bearing tightly against the foam coating and dimensioned such that it can absorb the bursting force which occurs in the event of a fault inside the vacuum interrupter:

However, the sheathing of the interrupter includes a permanently foamed plastic material whose properties can be impaired by aging. In particular, embrittlement or detachment of the foam coating from the outer housing of the interrupter can occur. In addition, this encapsulated vacuum interrupter can be dismounted only given destruction of the enclosure.

Therefore, a load interrupter switch that is capable of use over a long period of time, which does not require monitoring and may be dismounted is needed.

SUMMARY OF THE INVENTION

The load interrupt switch of this invention has a housing which is surrounded by a prefabricated sleeve. The prefabricated sleeve grips the edges of the two end plates and consists of an elastomeric material of high dielectric strength which is pressed against the housing to prevent air gaps.

Because of the elastic properties of the sleeve, air gaps are not formed on the periphery of the housing. Since air gaps are not formed, An external flashover on the vacuum interrupter chamber is prevented.

A further advantage of this invention is that the edges of the two end plates of the vacuum interrupter chamber are gripped behind by the sleeve. This results in a substantial lengthening of the path for a possible external flashover, thus even more reliably suppressing this possibility. Since the use of the sleeve nullifies the need of a liquid or gaseous media, the load interrupter switch has numerous further advantages.

Thus, the complicated monitoring activities for checking the liquid levels or the state of the pressure are eliminated. The load interrupter switch can therefore be operated continuously over many years without the need to check the sleeve acting as dielectric medium.

Furthermore, impairment of the environment by escaping media is thereby avoided, as a result of which the load interrupter switch according to the invention can be used, for example, without objection in protected water gathering grounds as well. A continuously useable load interrupter switch which can be universally employed is thereby provided.

A further advantage resides in that mounting the load interrupter switch according to the invention is substantially simplified. Thus, the construction with a prefabricated sleeve permits preassembly of the arrangement. Therefore there is no need for an outlay on final mounting or filling high up on the mast. Since no liquid or gaseous medium is handled, there is a substantial simplification in the complexity of transporting and installing the load interrupter switch.

The load interrupter switch according to the invention is simple to produce and may be dismounted if required. In addition, the space requirement and the production costs for the vacuum interrupter are lower than conventional vacuum interrupters.

On the outside of the sleeve, a pressure housing of complementary construction is provided. This pressure housing is made from insulating material and pretensions the outer circumference of the sleeve in the elastic region. The sleeve presses firmly against the vacuum interrupter chamber to prevent air gaps which could permit an external flashover to occur on the outer circumference of the sleeve. The result of this increases the possible path length for an external flashover to a measure wherein a flashover is virtually no longer possible. Thus safe working conditions and the reliability of the load interrupter switch are further increased. Furthermore, the vacuum interrupter chamber is centered and fixed in the pressure housing.

Owing to the fact that the dimensions of the sleeve are selected such that the sleeve applies pretensioning to the vacuum interrupter chamber, the creation of an air gap between the sleeve and the housing of the vacuum interrupter chamber is reliably prevented. Consequently, the relatively large dimensional tolerances of the vacuum interrupter chamber can also be compensated. Thus the reliability of the load interrupter switch is further increased.

Sealing of the pressure housing with respect to external influences is achieved when the sleeve has at least one sealing bead which runs in the axial direction of the pressure housing and comes to lie in the mounting joint of the pressure housing. Thus the possibility of dirt and water penetrating into the pressure housing is greatly decreased. Therefore, failure of the load interrupter switch can thus be effectively avoided. Furthermore, the unipartite construction of the sleeve with the sealing bead facilitates the mounting of the arrangement.

If, in addition, the sealing bead has a thickened part which can be pinched in the mounting joint of the pressure housing. This results in the reliability of this seal on the pressure housing being further increased. The risk of an external flashover is still further reduced by virtue of the fact that circumferential shields are provided which project on the outer circumference of the sleeve in a fashion essentially parallel to the end plates.

It is further advantageous when the sleeve has at least one cut-out for holding sleeve material displaced during the pressure loading. The result of this is that the sleeve bears cleanly against the circumferential surface of the vacuum interrupter chamber without the sleeve being damaged by the pressure forces applied. The reliability of the load interrupter switch is thereby further increased.

The at least one cut-out is advantageously constructed as a circumferential annular groove in the inner periphery of the sleeve. A uniform pressure distribution over the entire circumference of the vacuum interrupter chamber is thereby achieved.

If the sleeve is provided with at least one pocket on at least one end face in the region of at least one end plate, it is possible for the length of the vacuum interrupter chamber to be set in the mounted state without damage to the material of the sleeve, since said material can escape into the at least one pocket. The reliability of the sleeve, and thus the operational reliability of the load interrupter switch is thereby increased. Moreover, if the at least one pocket is, constructed annularly, the result is a uniform distribution of the pressure load on the end face of the sleeve.

The sleeve according to the invention is may be made from EPDM (ethylene-propylene terpolymer) or silicone rubber, which have good elastic properties and are also incompressible. Such materials permit reliable sealing of the interface between the vacuum interrupter chamber and the sleeve and/or between the sleeve and the pressure housing of the load interrupter switch. Thus, an external flashover can be reliably avoided.

Since the load interrupter switch is constructed as a switch-disconnector, when a visible isolating distance is arranged in series with the vacuum interrupter chamber, it is possible to carry out visual monitoring from a relatively large distance in order to determine whether the load interrupter switch is closed.

When the load interrupter switch is in a closed state, a circuit having high continuous current-carrying capacity may be connected in parallel with the vacuum interrupter chamber or in parallel with the series circuit of the vacuum interrupter chamber/visible isolating distance. The vacuum interrupter is relieved when the load interrupter switch (switch-disconnector) is in the closed state. This has the advantage that the existing high voltages are applied to the vacuum interrupter chamber only during the switching operations. In this case, a continuous current can be conducted which is higher than the rated current of the interrupter chamber or the series circuit of the vacuum interrupter chamber and visible isolating distance. Thus, the service life of the load interrupter switch is substantially increased.

BRIEF DESCRIPTION OF THE DRAWINGS

The invention will be better understood in view of the following detailed description made in conjunction with the accompanying drawings, in which.

DETAILED DESCRIPTION

Figure 1:
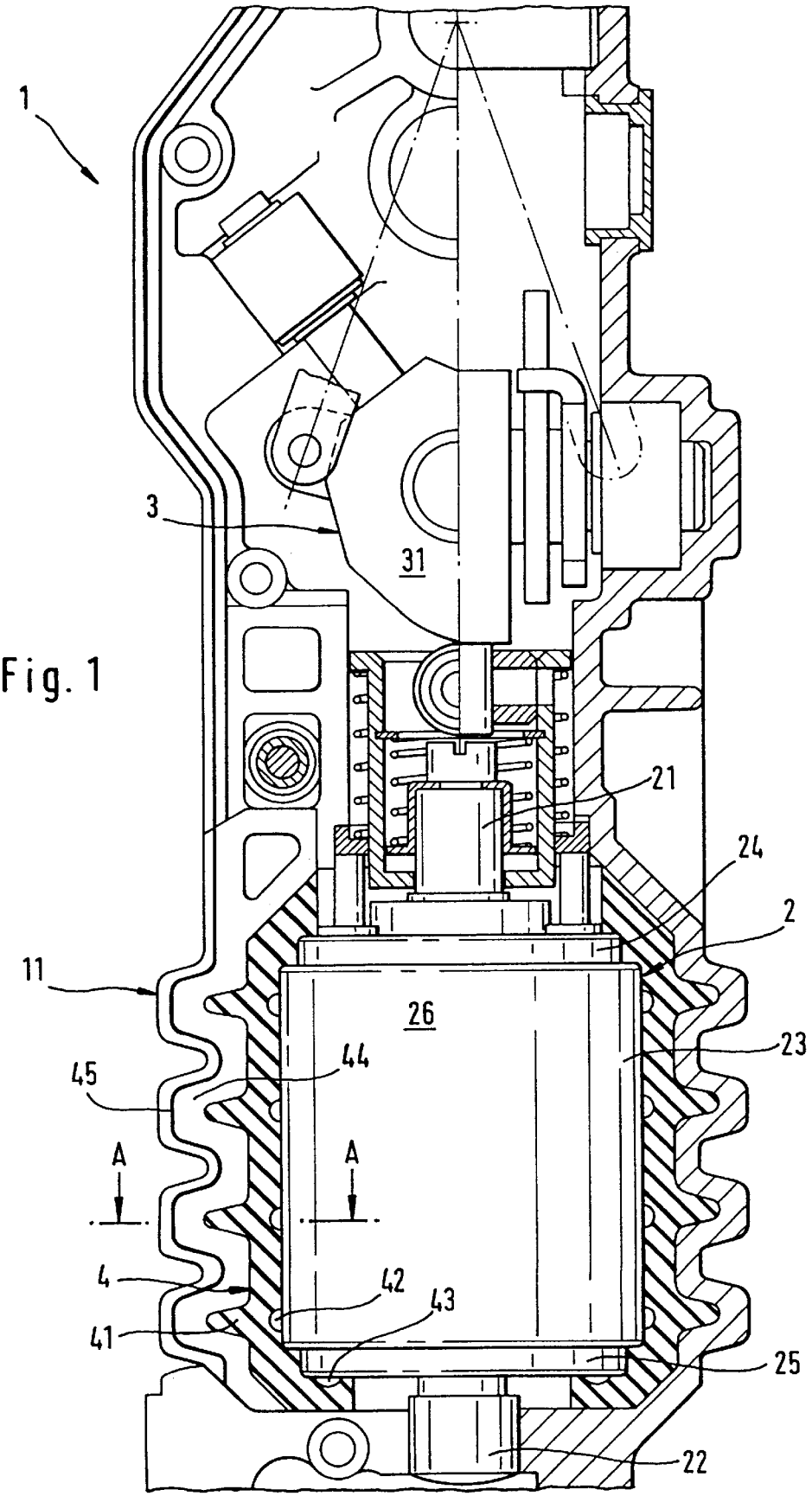
FIG. 1 shows a sectional representation of a load interrupter switch.

In accordance with the representation in the figures, a load interrupter switch 1 has a pressure housing with two half housings 11 and 12 which are constructed from insulating material and in an essentially mirror-symmetrical fashion. A vacuum interrupter chamber 2 and a switching mechanism 3 are arranged in the half housings 11 and 12. The mode of arrangement and the functioning of the vacuum interrupter chamber 2 and the switching mechanism 3 correspond to the known embodiments, therefore a detailed explanation is dispensed with in this connection. The interior of the vacuum interrupter chamber 2 has switching contacts which are closed and opened by the switching mechanism 3. The switching mechanism 3 is constructed with an eccentric actuating element 31 which acts on a moveable contact 21 of the vacuum interrupter chamber 2.

In addition to the moveable contact 21, the vacuum interrupter chamber 2 has a stationary contact 22 which is arranged opposite the moveable contact 21. The vacuum interrupter chamber 2 further has a housing 23 which is provided with metallic end plates 24 and 25 which seal a cylindrical housing middle part 26. The housing middle part 26 is produced from electrically insulating material. Inside the vacuum interrupter chamber 2 is a high vacuum which ensures interruption in the case of disconnection, and voltage stability while in the disconnected state.

In order to ensure that no external flashover of the voltage occurs between the end plates 24 and 25 of the vacuum interrupter chamber 2, a sleeve 4 made from EPDM (ethylene-propylene terpolymer) is arranged around the vacuum interrupter chamber 2. This sleeve 4 is constructed in this case in such a way that it embraces the edges of the two end plates 24 and 25 of the vacuum interrupter chamber 2. Furthermore, the dimensions of the sleeve 4 are selected such that tolerance deviations in the vacuum interrupter chamber 2 can be compensated. The sleeve 4 bears pretensioning or presses against the circumferential surface of the vacuum interrupter chamber 2. Consequently, there is no continuous air gaps between the end plates 24 and 25, since sleeve 4 tightly embraces the vacuum interrupter chamber 2 and the edges of the end plates 24 and 25.

The sleeve 4 is embraced and pretensioned by the half housings 11 and 12 of the load interrupter switch 1. Because of the pretensioning, no air gaps which would permit an external flashover of the voltage between the end plates 24 and 25 of the vacuum interrupter chamber 2 exists between the sleeve 4 and the mounted half housings 11 and 12.

In accordance with the representation in FIG. 1, the sleeve 4 has annularly constructed shields 41 which are held in corresponding cut-outs in the half housings 11 and 12. The shields 41 serve in a known way to lengthen the path (leakage path) along the surface.

The sleeve 4 also has four cut-outs 42, which are arranged on the inner circumferential surface and have an annular configuration. When the half housings 11 and 12 are closed, pressure is exerted on the sleeve 4. Since the latter is produced from an elastomeric material which is elastic but essentially incompressible, the cut-outs 42 permit the material of the sleeve 4 to escape into the free spaces thereby formed. This prevents damage to the sleeve 4 and results in good sealing of the interface between the sleeve 4 and the vacuum interrupter chamber 2.

Furthermore, an annular pocket 43 is constructed at the end of the sleeve 4 which grips over the end plate 25 in the region of the stationary contact 22. Since vacuum interrupter chambers 2 have relatively large length tolerances, it is necessary in some circumstances to set the length and/or position of the vacuum interrupter chamber 2 in the load interrupter switch 1. In order to permit the deformation of the sleeve 4 necessary for the purpose in this end face region, the annular pocket 43 serves as a chamber for equalizing the volume of the displaced material.

Figure 2:
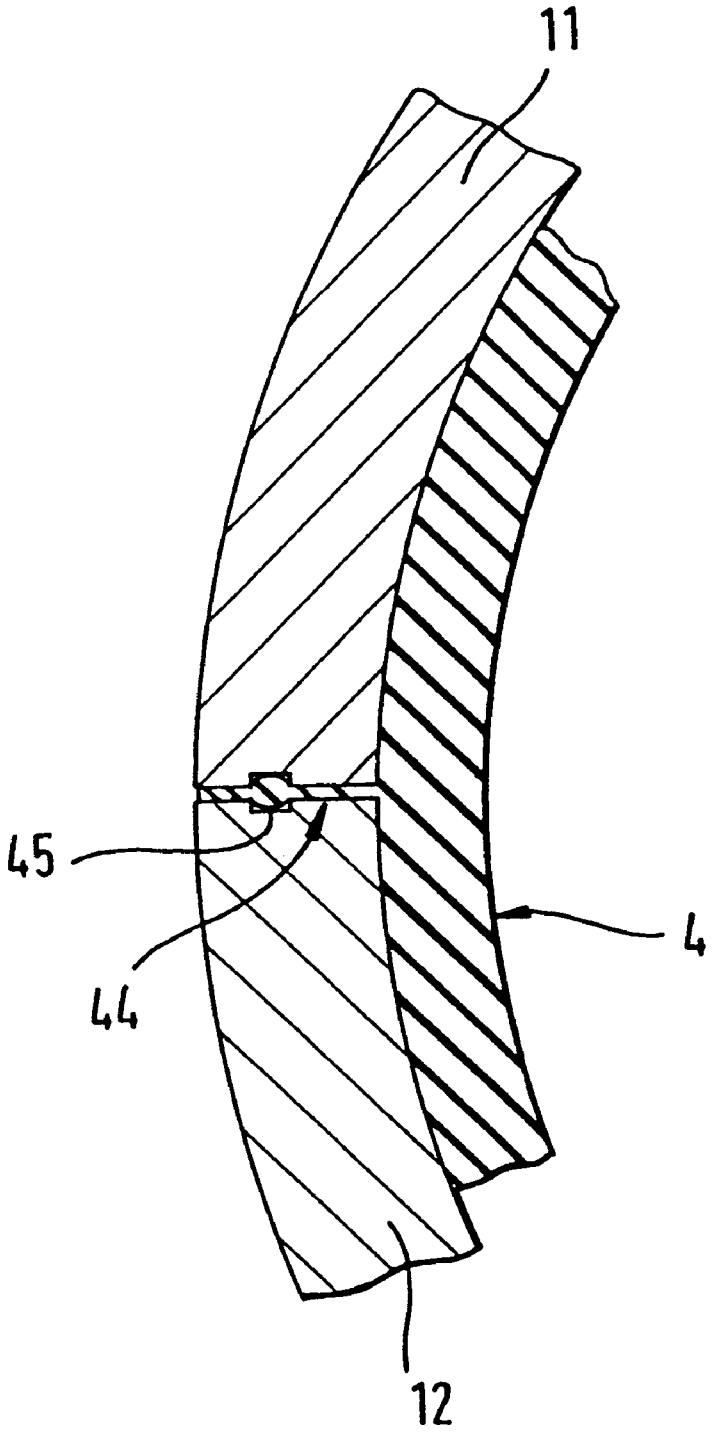
FIG. 2 shows a simplified sectional representation in accordance with the line A—A in FIG. 1.

In accordance with the representation in FIG. 2, the sleeve 4 further has a sealing bead 44 with a thickened part 45. These are arranged in each case on the two mounting joints of the half housings 11 and 12 of the load interrupter switch 1 for the purpose of sealing with respect to external influences. The thickened part 45 is held in this case in correspondingly constructed depressions or grooves on the joint surfaces of the half housings 11 and 12, and pinched when the half housings 11 and 12 are closed. The sealing bead 44 with the thickened part 45 in this case has a length which corresponds essentially to the total length of the sleeve 4. However, it can also be constructed in the entire mounting joint region of the half housings 11 and 12 in one piece with the sleeve 4 as a cord for sealing the pressure housing. The pressure housing has a pressure contact with sleeve 4.

When the load interrupter switch 1 is opened in operation, the contacts 21 and 22, which are under pretensioning by springs, are released by the switching mechanism 3, with the result that they open the switching contacts in the vacuum interrupter chamber 2. Because of the high voltage applied, which can be 45 kV, for example, depending on the application, the arrangement tends to seek a path for a possible discharge of voltage through an arc. This is not possible inside the vacuum interrupter chamber 3 because of the vacuum.

Since the sleeve 4 bears under pretensioning or presses against the housing 23 of the vacuum interrupter chamber 2 and is connected under pretensioning to the pressure housing of the load interrupter switch 1, there are no air gaps present which would permit a voltage flashover. A flashover through the material of the sleeve 4 is likewise not possible because of the high dielectric strength of the material used for the sleeve 4. Such an external flashover is therefore prevented.

In an example of use, the load interrupter switch is used as a switch-disconnector and arranged in series with a visible isolating distance. In this arrangement, a traction circuit designed for continuous load current is connected in parallel with the vacuum interrupter chamber and an auxiliary switching point connected in series with the latter, as a result of which the vacuum interrupter is relieved with the switch-disconnector switched through. To disconnect the switch-disconnector, the first step is to open the main contact in the known way, resulting in the voltage being conducted completely across the vacuum interrupter chamber 2. Subsequently, the contacts 21 and 22 of the vacuum interrupter chamber 2 are separated and the connection is completely interrupted without an arc flashover being able to form in the load interrupter switch 1.

The invention permits further approaches to configuration in addition to the exemplary embodiment set forth here.

The dimensions and configuration of the sleeve 4 can vary, depending on the design and type of construction of the vacuum interrupter chamber 2. It is essential in each case in this regard that the sleeve 4 bears against the vacuum interrupter chamber 2 in such a way that air gaps are not possible therebetween.

The sleeve 4 need not be constructed with shields 41, but can also have an outer circumferential surface which is of a different configuration or smooth if it allows the safety of the load interrupter switch 1, for example on the basis of low prevailing voltages.

In the example shown, the cut-outs 42 in the sleeve 4 have semicircular cross sections and are constructed at four points around the vacuum interrupter chamber 2. Both the configuration and number of the annular cut-outs 42 can deviate from this. Furthermore, it is also possible to provide the cut-outs 42 with an annular configuration, instead of the embodiment shown, at points on the inner circumferential surface of the sleeve 4.

The pocket 43 in the sleeve 4 can also be provided on both end faces. Moreover, the configuration and the number of pockets 43 can vary in a way similar to that in the case of the cut-outs 42.

The sleeve 4 can be used in an arbitrary way in conjunction with vacuum interrupter chambers 2, something which also includes switching elements other than switch-disconnectors. Thus, use in circuit-breakers and the like is also conceivable.

The pressure housing can also comprise more than two part housings, the number of the sealing beads 44 being matched to the number of the mounting joints.

Furthermore, it is also possible to provide in parallel with the vacuum interrupter chamber 2 a continuous current or primary current contact system which permits the load interrupter switch 1 to be designed for various nominal or continuous currents in conjunction with the use of a specific vacuum interrupter chamber 2.

The foregoing description of the present invention provides illustration and description, but is not intended to be exhaustive or to limit the invention to the precise form disclosed. Modifications and variations are possible consistent with the above teachings or may be acquired from practice of the invention. Accordingly, the scope of the invention is defined by the claims and their equivalents.

What is claimed is:

1. A load interrupter switch for voltages above 1 kV, comprising:

a vacuum interrupter chamber comprising:

a movable contact;

an inner housing having metallic end plates, wherein the movable contact is adjacent to at least one of the metallic end plates; and a cylindrical housing middle part sealed inside the inner housing, the cylindrical housing middle part formed from electrically insulating material;

a switching mechanism for opening and closing the movable contact;

a sleeve formed from an elastomeric material of high dielectric strength arranged around the vacuum interrupter chamber and gripping edges of the metallic end plates; and a pressure housing having a pressure contact against the sleeve and forming a jacket of complementary construction around the sleeve, wherein the sleeve prevents continuous air gaps between the metallic end plates.

2. The load interrupter switch according to claim 1, wherein the sleeve has a pressure contact against the circumference of the vacuum interrupter chamber.

3. The load interrupter switch according to claim 2, wherein the sleeve has at least one sealing bead which runs in the axial direction of the pressure housing and is arranged in a mounting joint of the pressure housing.

4. The load interrupter switch according to claim 3, wherein the sealing bead has a thickened part which can be pinched in the mounting joint.

5. The load interrupter switch according to claim 1, wherein the sleeve comprises circumferential shields arranged in a fashion essentially parallel to the metallic end plates.

6. The load interrupter switch according to claim 1, wherein the sleeve comprises at least one cut-out for holding displaced material.

7. The load interrupter switch according to claim 6, wherein the at least one cut-out is formed as a circumferential annular groove.

8. The load interrupter switch according to 1, wherein at least one pocket is formed on the sleeve in a region near at least one of the metallic end plates.

9. The load interrupter switch according to claim 8, wherein the at least one pocket is formed as an annular groove.

10. The load interrupter switch according to claim 1, wherein the sleeve is formed from silicone rubber or from EPDM (Ethylene-Propylene-Terpolymer).

* * * * *